United States Patent [19]

Otsuka et al.

[11] Patent Number: 4,671,338

[45] Date of Patent: Jun. 9, 1987

[54] FORCED COOLING CASTING APPARATUS

[75] Inventors: Yukio Otsuka; Hiroshi Kawai; Kiyomi Iida; Hironobu Nakano, all of Toyota, Japan

[73] Assignee: Toyota Jidosha Kabushiki Kaisha, Toyota, Japan

[21] Appl. No.: 853,722

[22] Filed: Apr. 18, 1986

[51] Int. Cl.[4] ..... B22D 27/04; B22D 29/00; B22D 33/02; B22D 47/02

[52] U.S. Cl. ..... 164/150; 164/323; 164/339; 164/342; 164/344; 164/348

[58] Field of Search ..... 164/348, 126, 128, 4.1, 164/458, 150, 339, 342, 344, 323, 348

[56] References Cited

U.S. PATENT DOCUMENTS

| | | | |
|---|---|---|---|
| 2,110,360 | 3/1938 | Fisher | 164/348 X |
| 3,590,904 | 7/1971 | Woodburn, Jr. | 164/348 X |
| 4,270,594 | 6/1981 | Chumakov | 164/348 X |
| 4,585,047 | 4/1986 | Kawai et al. | 164/348 X |

*Primary Examiner*—Nicholas P. Godici
*Assistant Examiner*—J. Reed Batten, Jr.
*Attorney, Agent, or Firm*—Oblon, Fisher, Spivak, McClelland & Maier

[57] ABSTRACT

A forced cooling casting apparatus has a loop track for guiding a stool having a lower mold fitted thereto and having a punch-out portion. A plurality of stations are sequentially disposed on the loop track for effecting the steps of cleaning the lower mold, arranging an upper mold, inserting tubular members for cooling, setting a cooling plate having a plurality of cooling nozzles for passing a cooling medium through the tubular members, pouring a molten metal, effecting cooling in several stages, removing the cooling plate and taking out the resulting casting. A cooling medium tube communicates with the cooling nozzles, having a coupler and disposed on the cooling plate. A cooling medium feeder is connected to the coupler and/or a cooling medium jet device for cooling the lower mold, and is disposed at each of the cooling stations.

5 Claims, 20 Drawing Figures

FORCED COOLING CASTING APPARATUS

BACKGROUND OF THE INVENTION

1. Field of the Invention

This invention relates generally to a forced cooling casting apparatus, and more particularly to a casting apparatus which carries out casting using a forced cooling method by placing a plurality of casting molds in a loop line (track).

2. Description of the Related Art

When aluminum alloys are cast in accordance with the prior art methods, an extended period of time is necessary for solidification, and undesirable directionality occurs during solidification, based upon the shape or casting molds, so that low quality castings with defects such as blow holes are likely to be obtained. Various improvements have been made to the casting methods per se. In accordance with Japanese Public Patent Application No. 86966/1983, for example, tubular members are disposed in the cavity of the casting mold and are entrapped by a molten metal poured into the cavity. This is also shown in U.S. patent application Ser. No. 814,929, filed on Dec. 30, 1985. See also U.S. patent application Ser. No. 853,721 having the same filing date as the present application and entitled "FORCED COOLING CASTING APPARATUS," both of which are incorporated by reference. A cooling medium such as water is caused to flow through these tubular members to promote solidification of the molten metal. According to this method, since directional solidification is obtained in an outward direction due to the tubular member being at the center, blow holes or the like are less likely to occur in the castings and the quality can therefore be improved. At the same time, various other methods are known to promote solidification, such as methods using a chiller, a mold cooling method and so forth, and these methods are combined with one another in various forms to eliminate the defects peculiar to casting.

Promotion of solidification is necessary from the aspect of production efficiency, but there are inherent limits to the cooling speed and cooling methods from the aspect of quality of the resulting castings. Therefore, as a method of promoting solidification and accomplishing mass production of castings, attempts have been made to turn the casting operations into a flow process by, for example, disposing a plurality of casting molds on a rotary circular bed and sequentially carrying out casting steps such as cleaning a mold, arranging the mold, inserting a core, clamping the mold, pouring molten metal, and so forth.

However, such a flow process uses a plurality of casting machines, so that necessary equipmeht becomes complicated in construction and the cost of production of castings becomes higher. Therefore, an improvement in production efficiency is deemed necessary in order to rapidly supply the products.

SUMMARY OF THE INVENTION

In order to eliminate the problems of the prior art described above, the present invention has as its object to provide a forced cooling casting apparatus which inserts tubular members into a cavity in order to permit a cooling medium to flow through the tubular members and thus to form high quality castings, or which places a plurality of casting molds, which cool with water to cause directional solidification of the molten metal, into a loop system casting line in order to drastically shorten the casting cycle.

The loop casting line has stations to carry out the following steps: a cleaning step of a lower mold set on a movable stool, a step of arranging an upper mold on the lower mold, a step of inserting tubular members in the molds, a step of setting a cooling plate on the upper mold, a step of checking the cooling plate, a step of pouring molten metal, cooling steps, a step of removing the cooling plate and a step of taking out products.

The cooling step is divided into several steps. In order to supply the cooling medium to a plurality of tubular members, the conventional method disposes a plurality of cooling nozzles in such a manner as to correspond to the tubular members and supplies the cooling medium to each of the cooling nozzles. According to the invention, one cooling medium tube is passed through the cooling plate and is communicated with each of the cooling nozzles, one coupler is disposed in the cooling tube, and a cooling medium feeder which is fixed on the side of a casting line main body is detachably connected to the coupler so as to cause the cooling medium to flow through each tubular member.

It is another object of the present invention to provide a forced cooling casting apparatus which jets the cooling medium to the lower mold from a cooling medium jet device disposed below the casting line main body at each cooling step in order to carry out more efficient directional solidification.

It is still another object of the present invention to release the products from the mold by pushing a product extraction pin disposed on the lower mold by an extraction plate disposed on the lower side of the casting line main body at a step of hoisting and conveying the product on the production line, and thus to permit movement of the product by a hoist conveyor device.

It is a further object of the present invention to provide an abnormality detector which detects abnormal fitting of the cooling nozzles disposed on the cooling plate to the tubular members for cooling that are inserted through the mold, and an abnormal setting of the cooling plate when the cooling plate is set for forced cooling of the molten metal.

As described above, in the flow process of the casting operation, the present invention turns the casting line into a loop line for moving the stool, distributes the cooling medium supplied from one coupler to each tubular member for cooling the molten metal, divides the cooling step into a plurality of steps and connects the cooling medium feeder fixed to the casting line main body to the coupler at each cooling step. Therefore, the workpieces on the line as a whole move with the molten metal pouring time as a reference, and a forced cooling casting apparatus can be obtained which is extremely simple in construction and has a shorter casting cycle.

In addition to cooling and solidification by means of the tubular members that are inserted through the cooling plate, cooling is effected also by cooling the lower mold within a punch-out area of the stool by a cooling medium jet device, and directional solidification can be effected reliably and rapidly from below the cavity in the direction of the molten metal so that high quality castings can be obtained.

Mold release of the products is effected by the extraction pin immediately before the take-out of the products, and since this extraction pin returns automatically to its position by a spring, operational efficiency can be further improved.

Since the set condition of the cooling plate and the cooling nozzles can be checked in advance by the abnormality detector, insufficient cooling and inferior solidification of the molten metal can be prevented and casting of high quality products can be insured.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

The construction or the present invention will now be described with reference to its preferred embodiment shown in the accompanying drawings.

Figure 1:
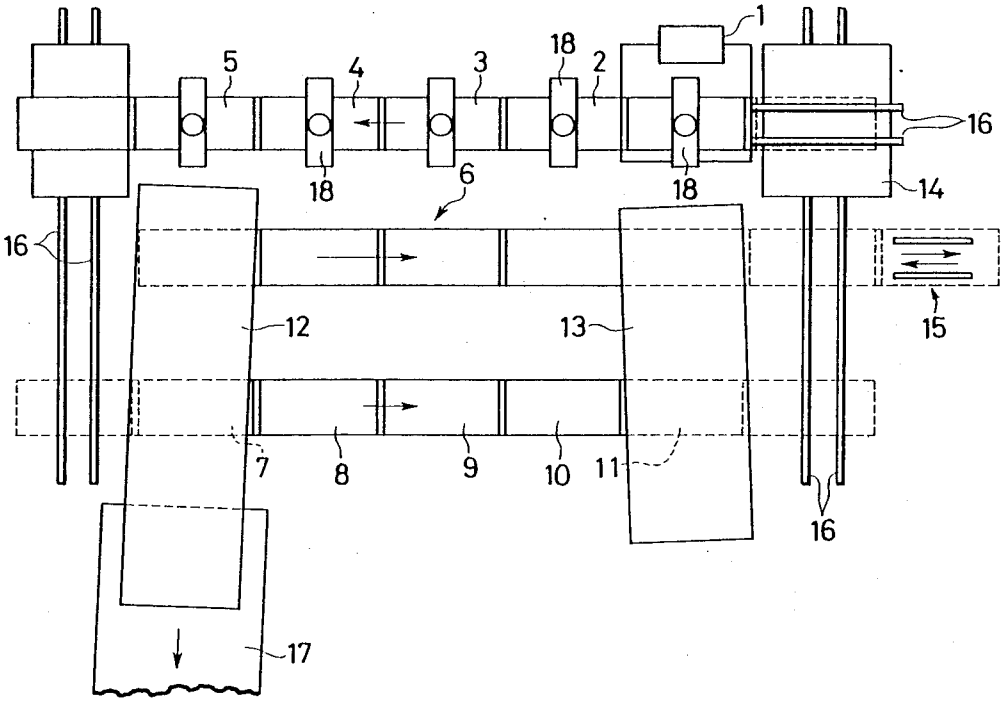
FIG. 1 is a plan view showing a forced cooling casting apparatus in accordance with the present invention.

FIG. 1 is a schematic plan view showing a forced cooling casting apparatus as a whole in accordance with the present invention. Reference numeral 1 represents a molten metal pouring/cooling station, and reference numerals 2 through 5 are subsequent cooling stations. A hoist conveyor 12 lifts up a cooling plate 31 from a casting mold, moves the cooling plate to a center line 6 for transport to hoist conveyor 13 and further transfers a product to a conveyor belt 17. Reference numeral 8 represents a lower mold cleaning station; 9 is an upper mold arrangement station; 10 is a tubular member disposition station; 11 is a station where the cooling plate transferred from the center line 6 by the hoist conveyor 13 is put onto a casting mold; 14 is a traverser; and 15 is a mold exchange station which is used when a mold on a stool must be changed. Reference numeral 16 represents a rail on which the stool supporting thereon a casting mold moves.

The casting loop of the casting apparatus of the present invention consists fundamentally of the constituent members 1 through 14 described above.

Next, the construction of the casting molds which moves on the rail 16 described above will now be explained with reference to FIGS. 2 through 5.

Figure 2:
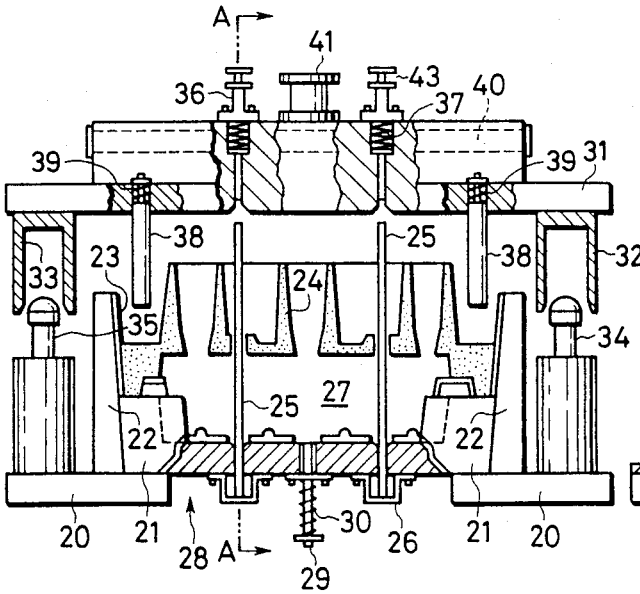
FIG. 2 is a partial exploded side view showing a casting machine immediately before a cooling plate is disposed thereon.
Figure 3:
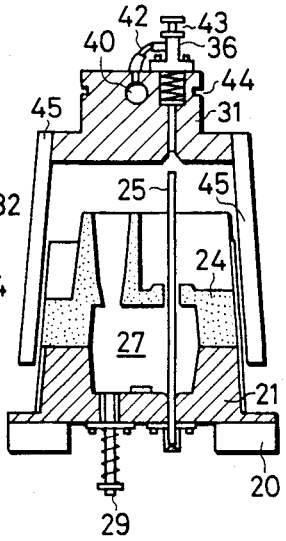
FIG. 3 is a sectional view taken along line A—A of FIG. 2.
Figure 4:
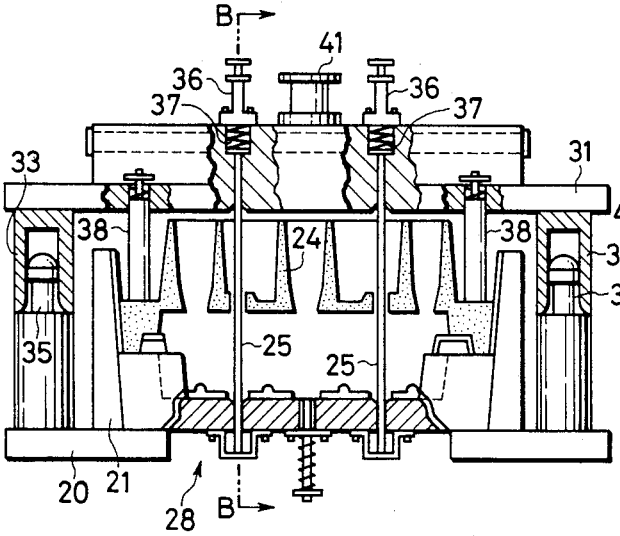
FIG. 4 is a partial exploded side view showing the casting machine after disposition of the cooling plate is completed.
Figure 5:
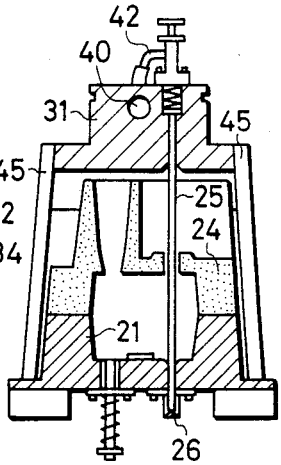
FIG. 5 is a sectional view taken along line B—B of FIG. 4.

FIG. 2 is a side view of the station 11 in FIG. 1, that is, the state immediately before the cooling plate is disposed on the casting mold. FIG. 3 is a sectional view taken along line A—A of FIG. 2, FIG. 4 is a side view after completion of the disposition of the cooling plate on the casting mold and FIG. 5 is a sectional view taken along line B—B of FIG. 4.

In the drawings, reference numeral 20 represents the stool and 21 is a lower mold fixed to the stool. Reference numeral 22 represents a pair of upper mold guides fixed to the longitudinal end portions of the lower mold, and a vertically extending guide projection 23 is disposed on the opposed surfaces of the guides 22 in order to locate an upper mold in its transverse direction. Reference numeral 24 represents the upper mold consisting of a sand mold. Reference numeral 25 represents tubular members that are disposed in such a manner as to penetrate through the lower mold, the upper mold and a cavity 27, and are held at their lower end by tubular member receivers 26. The upper end of each tubular member projects above the upper mold. Reference numeral 28 represents a punch-out portion of the stool 20; the tubular member receivers 26 are disposed within this punch-out portion. Reference numeral 29 represents a mold press extraction pin and 30 is a spring which urges the mold press extraction pin 29 downwardly. Reference numeral 31 represents a cooling plate. FIG. 2 shows the state before the cooling plate is set onto the stool and FIG. 4 shows the state after it is so set.

Reference numerals 32 and 33 represent bushes that are disposed on the lower surface at both end portions of the cooling plate and fit to the guide pins 34, 35 fixed to the end portions of the stool 20, thereby locating the cooling plate. Reference numeral 36 represents a plurality of cooling nozzles that are disposed in the cooling plate 31. The tip of each cooling nozzle has a smaller diameter than the diameter of the tubular member 25 so that the tip can be inserted into the upper end of the tubular member 25. A spring 37 urges the cooling nozzle in the direction of the tubular member and makes their fitting more reliable. Reference numeral 38 represents a mold support which is disposed on the cooling plate and urged by a spring 39 towards the mold. The force of this spring is set to be smaller than the total load of the cooling plate so that the load difference supports the mold. Reference numeral 40 represents a cooling medium tube, which has a coupler 41 connected to a cooling medium feeder 18 disposed on the side of a casting line main body. Reference numeral 42 represents one of a plurality of connection tubes that connect the cooling medium tube 40 to the cooling nozzles 36 and distributes the cooling medium into each cooling nozzle. Reference numeral 43 represents a circumferential groove defined at the head of the cooling nozzle, and reference numeral 44 represents a groove formed at a part of the cooling plate. These grooves accept the antennas of an abnormality detector to be described below. Reference numeral 45 represents a taper case disposed on the side surface of the cooling plate and extending in its longitudinal direction, and which has an inclination matching the inclination of the mold in order to prevent leakage of the molten metal from the mold.

Figure 6:
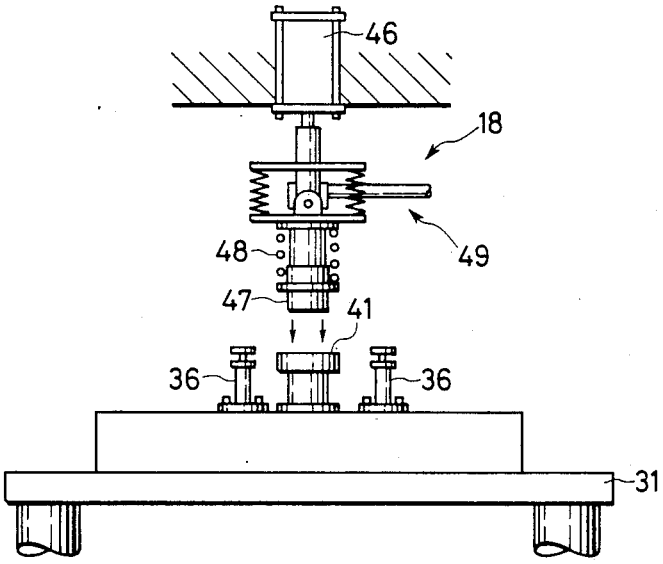
FIG. 6 is a side view showing a cooling medium feeder.

Next, the cooling medium feeder 18 disposed on the side of the casting line main body will be described with reference to FIG. 6. This device is disposed at each of the stations 1 through 5 of the casting line main body in FIG. 1. The piston of cylinder 46 fixed to the line main body may be lowered in the direction indicated by an arrow and so connects orifice member 47 to the coupler 41 disposed at the cooling medium tube of the cooling plate 31 to supply the cooling medium thereto from the cooling medium tube 49.

FIGS. 7 through 11 show the construction for water-cooling the lower mold by the cooling medium jet device disposed on the casting line main body below the stool in association with the movable casting machine and the construction of a mold extraction apparatus equipped with a return spring for extracting the casting mold after cooling and solidification.

Figure 7:
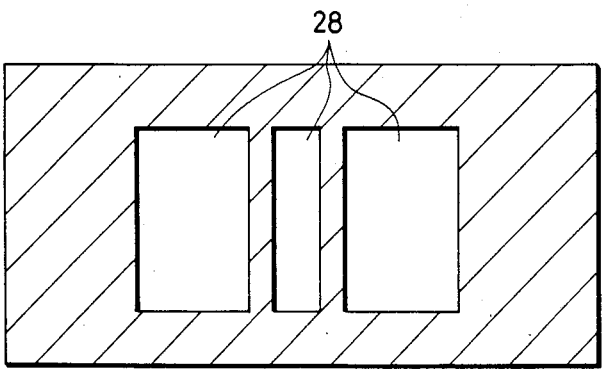
FIG. 7 is a bottom view showing the punch-out of a stool.
Figure 8:
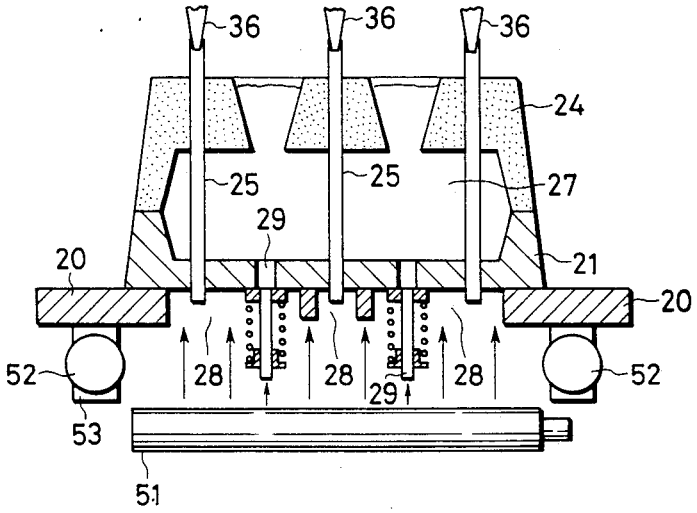
FIG. 8 is a side view showing a cooling medium jet device.
Figure 9:
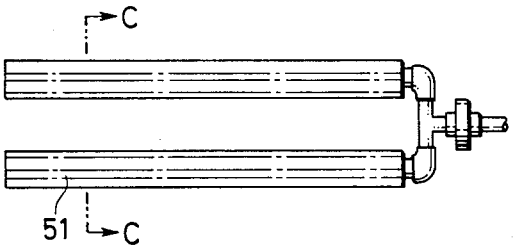
FIG. 9 is a plan view showing the cooling medium jet device.
Figure 10:
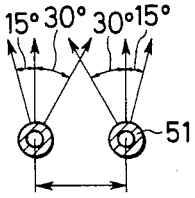
FIG. 10 is a sectional view taken along line C—C of FIG. 9.

FIG. 7 is a bottom view of the stool which is punched out, and reference numeral 28 represents the hollow portions. FIG. 8 is a side view showing the relation between the cooling medium jet device 51 and the lower mold, and the cooling medium jetted from the jet device being sprayed to the lower mold through the hollow portions 28 and with a spray pattern shown in FIG. 10. FIG. 9 is a plan view of the jet device disposed at each station 1–5 shown in FIG. 1. In FIG. 8, reference numeral 52 represents a roller disposed at a bearing portion 53 of the stool. The roller rolls on the rail 16 shown in FIG. 1 and moves the stool. Reference numeral 29 represents the extraction pin for extracting the casting from the mold. Since the pin penetrates through the lower mold and is exposed on the surface of the cavity 27, it also has the effect of a chiller by use of the cooling medium of the jet device.

Figure 11:
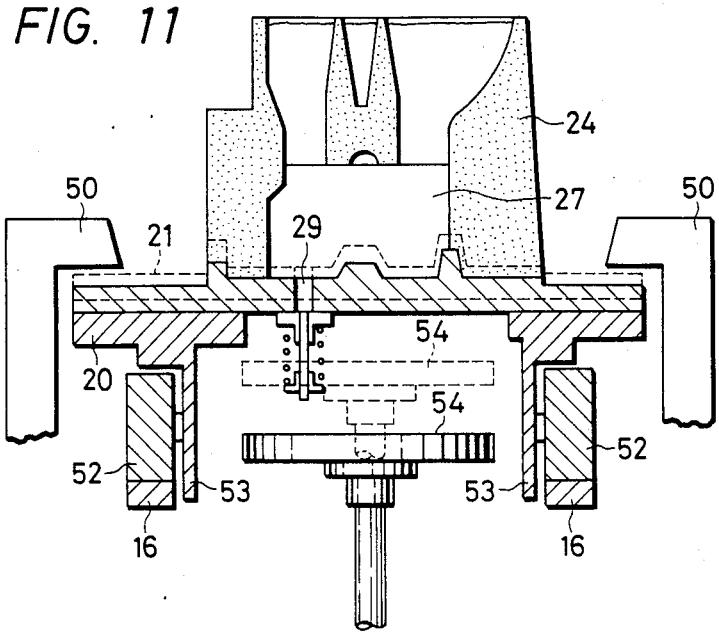
FIG. 11 is a side view showing an extraction pin and an extraction plate.

Next, referring to FIG. 11, there is shown a construction which removes the product from the mold by use of the extraction pin 29 for the product immediately before the product is lifted up at the seventh station of the casting apparatus of the invention shown in FIG. 1. In the drawing, reference numeral 54 represents an extraction plate, which is disposed at the seventh station in FIG. 1. At this station No. 7, the cooling plate is first removed and is transferred to the center line 6. Then, the extraction plate 54 is raised by a cylinder, not shown, and pushes up the extraction pin 29 which is disposed on the lower mold and has the return spring 30. Via this extraction pin the lower mold 21 is lifted together with the product. Mold release of the product from the lower mold is effected in a subsequent stroke after both ends of the lower mold impinge against lower mold support pawls 50. When the extraction plate 54 descends, the spring 30 returns the extraction pin 29 to the position represented by the solid line in FIG. 11.

Next, the forced cooling casting apparatus in accordance with the present invention also includes a device which judges whether or not the cooling plate is properly set, by means of an abnormality detector prior to the casting step at the first station 1 in FIG. 1, i.e., the molten metal pouring step. If the molten metal pouring step and the cooling step are carried out while the cooling plate is not properly set, the cooling medium cannot be supplied properly to the cavity 27 and defects of the products will occur.

Figure 12:
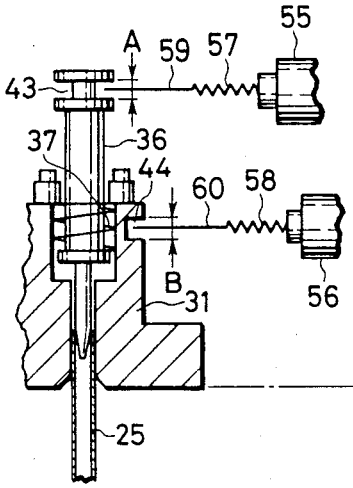
FIG. 12 is a schematic view showing an abnormality detector when no abnormality exists.
Figure 13:
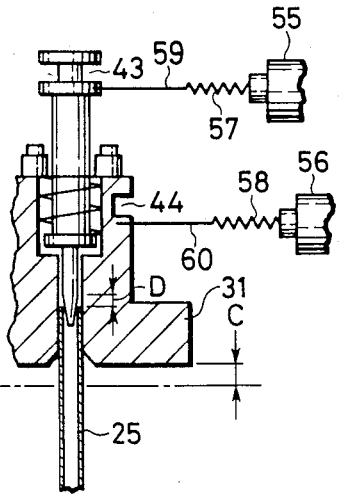
FIGS. 13 through 15 show detection modes of the abnormality detector.
Figure 14:
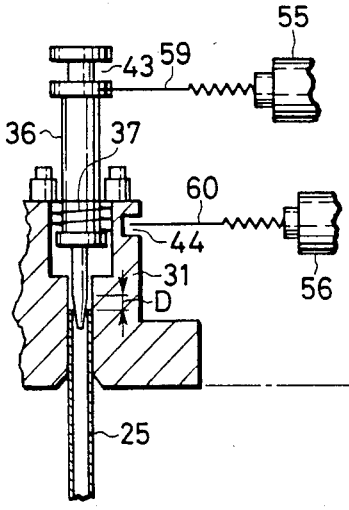
Figure 15:
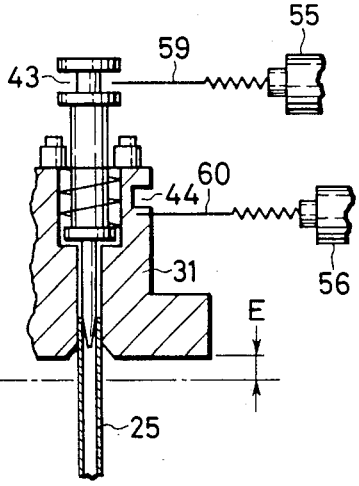

FIGS. 12 through 15 show the set state of the cooling plate 31 to the stool 20 and the state in which the tip of each cooling nozzle 36 is fitted into the projecting end of the tubular member 25. FIG. 12 shows a normal insertion state while FIGS. 13 through 15 show the occurrence of an abnormality. In these drawings, reference numeral 55 represents a limit type touch switch for the cooling nozzle, 59 is an antenna held by an antenna spring 57, 43 is a circumferential groove formed at the head of the cooling nozzle, 44 is a groove formed at a suitable position of the cooling plate 31, and 56 is a second limit type touch switch for the cooling plate 31. These limit switches 55 and 56 are for the cooling nozzle and for the cooling plate, respectively, and are set to the height corresponding to the circumferential groove 43 and to the groove 44 of the cooling plate, respectively. In other words, if these antenna can enter the corresponding grooves, they represent the normal height of the cooling nozzle 36 and the cooling plate 31.

Sensing of the height is effected in the following way. For example, while the cooling plate is set and is being transferred to the subsequent step such as the molten metal pouring step or the cooling station, the limit touch switch 55 and the second switch 56 are set in such a fashion that the antennas 59 and 60 enter the circumferential groove 43 and the groove 44, respectively. In the state shown in FIG. 12, the antennas pass through the width A of the circumferential groove 43 and through the width B of the groove 44, and this represents that the cooling plate and the cooling nozzles 36 are in the normal set condition.

In FIG. 13, since the cooling plate floats up from the casting mold by a dimension C, both antennas 59, 60 are in contact with the members forming the grooves. An electric signal from this contact causes a buzzer to sound, and the abnormal setting is interlocked with measures for the interruption of the casting operation.

In FIG. 14, fitting between the tip of the cooling nozzle and the tubular member is not sufficient by a distance D, even if the cooling plate is set normally, and hence the subsequent step is interrupted.

In FIG. 15, though the cooling nozzle is normally fitted to the tubular member, the cooling plate floats up by a dimension E, so that the subsequent step is likewise interrupted.

Next, the operation of the forced cooling casting apparatus having the construction described above will be explained.

This forced cooling casting apparatus constitutes a loop line and the flow of the line in this embodiment is such that the stool to which the casting mold is assembled is moved as one unit on the rail of the line. The power for the movement is time synchronized with other steps in the line, and is supplied by a press cylinder (not shown) disposed for each linear course of the line, for example.

Figure 16:
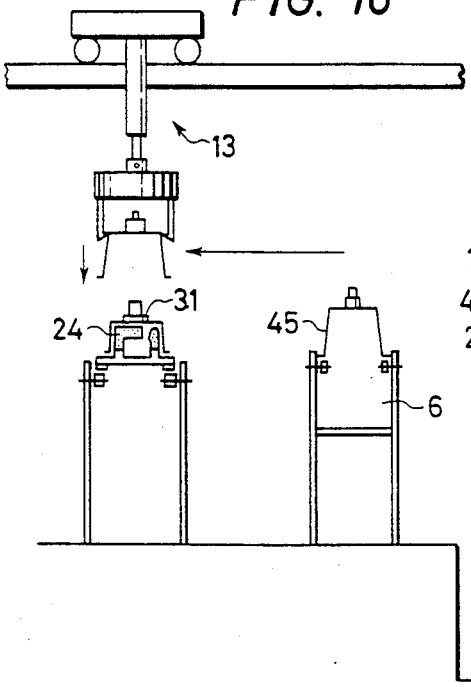
FIG. 16 is a schematic view of a station 11 shown in FIG. 1 at which the cooling plate is disposed.

First of all, the lower mold 21 set on the stool 20 is cleaned at the station 8 shown in FIG. 1, and the upper mold is then set thereon at the station 9. Next, the tubular members 25 are arranged in such a manner as to penetrate through the upper and lower molds and the cavity 27 at the station 10, and the conveyor 13 transfers the cooling plate 31 from the center line as shown in FIG. 16 and sets it on the stool as shown in FIGS. 2 and 4. Next, the stool is transferred to the traverser 14, but in an intermediate process, whether or not the cooling plate is correctly set is checked in the steps shown in FIGS. 12 through 15. If no abnormality is found, the cooling plate is moved by the traverser to the molten metal pouring station 1, where pouring of the molten metal is effected.

Figure 17:
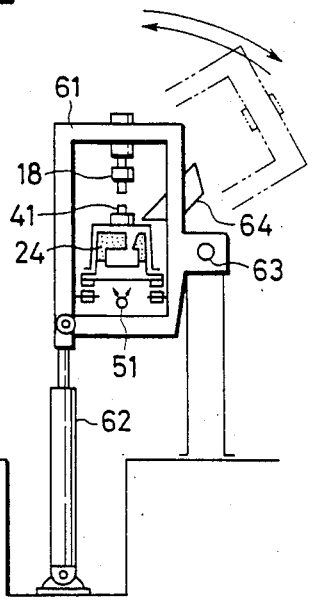
FIG. 17 is another schematic view of the station 1.

A conventional inclined molten metal pouring device such as shown in FIG. 17 is used for pouring the molten metal. Reference numeral 61 represents an inclined frame. While the casting mold including the rail is placed in this frame, the frame is pivoted by a cylinder 62 about an axis 63 as indicated by dotted lines in FIG. 17 and the molten metal is poured from a vessel 64 during its return to the position indicated by the solid line. The cooling medium is jetted from the cooling medium jet device 51 immediately before completion of pouring of the molten metal, and the cooling medium flows through the cooling plate and the tubular member from the cooling medium feeder connected to the coupler 41, thereby effecting initial cooling of the molten metal. The cooling medium feeder is then removed and the movement to the next cooling station 2 is effected.

Figure 18:
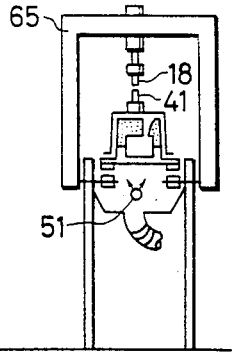
FIG. 18 is a schematic view of the cooling stations 2 through 5.

At the second to fifth cooling stations, the cooling medium is supplied from the cooling medium feeder 18 placed in the frame 65 to the coupler 41 as shown in FIG. 18, and cooling and solidification of the molten metal are promoted by cooling medium from feeder 18, together with that from the cooling medium jet device 51. In this embodiment, the second to fifth stations provide cooling steps, but these stations may of course be increased or decreased appropriately depending upon the size or shape of castings to be produced.

Figure 19:
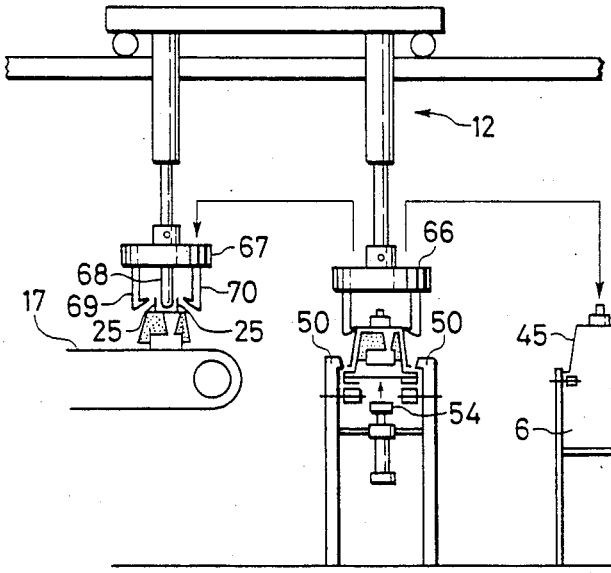
FIG. 19 is a schematic view showing the removal of the cooling plate and hoisting and conveying or resulting casting at the station 7.

After cooling and solidification are completed, and the mold is moved to station 7 by rails 16, the cooling plate 31 is first removed by the conveyor 12 as shown in FIG. 19 and transferred to the center line 6 for transport to conveyor 13. Next, the support plate 54 is elevated to cause mold release of the product, and then the product hoist device 67 lifts the resulting casting together with the upper mold to the conveyor belt 17. It is advisable to use an apparatus by which the ends of the tubular members 25 are crushed and clamped shut by movable arms relative to fixed arms 68. Since each tubular member consists of a pipe, it can be readily crushed by pushing an acute angled portion of the movable arm toward the fixed arm. Thereafter, the line returns to the station 8 for cleaning the lower mold, thereby completing one casting cycle.

Next, the results peculiar to the present invention will be illustrated by comparative experiments with the conventional method.

Figure 20:
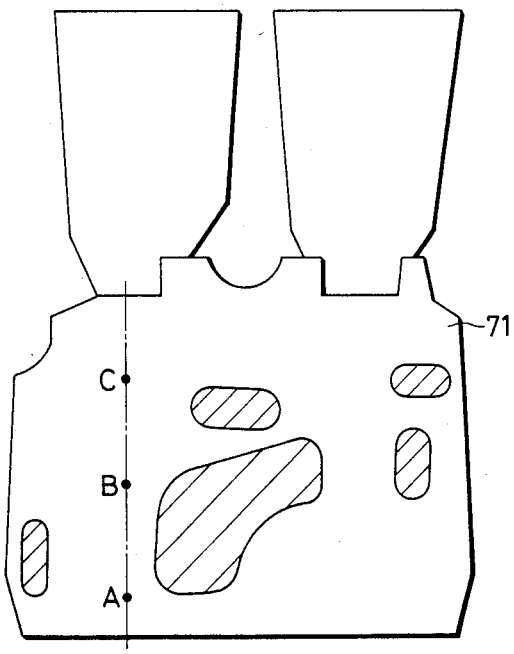
FIG. 20 is a sectional side view showing the measurement point of a two-dimensional eutectic crystal time of a cylinder head.

For example, when casting a cylinder head, the time at which an aluminum alloy starts forming eutectic crystals is measured at three points A, B and C shown in FIG. 20 with the result shown in the following table. For comparison, the conventional method No. 1 did not use forced cooling and the conventional method No. 2 used forced cooling by the tubular members. In accordance with the conventional method No. 1, inversion of solidification occurred at the point B and blow holes developed. In contrast, the difference between the two-dimensional eutectic crystal start time became greater at the points A, B and C in accordance with the present embodiment, and it can be understood that directional solidification took place.

| | A | B | C |
|---|---|---|---|
| The Invention | 20 sec | 1 min 45 sec | 2 min 10 sec |
| Conventional method 1 | 3 min 40 sec | 3 min 35 sec | 3 min 25 sec |
| Conventional method 2 | 1 min 30 sec | 2 min 15 sec | 2 min 53 sec |

Regarding strength, it was about 15 kgf/mm$^2$ in accordance with the conventional method No. 1 whereas it was improved to 35 kgf/mm$^2$ by the invention.

As to the yield of the resulting castings, it was about 50% in accordance with the conventional method No. 1 whereas it was improved to about 85% by the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A forced cooling casting apparatus comprising:

a loop track for guiding a stool having a lower mold fitted thereto;

a plurality of stations sequentially disposed on said loop track, said stations respectively having means for effecting the steps of cleaning said lower mold, arranging an upper mold on said lower mold, inserting tubular members for cooling in said upper and lower molds, setting a cooling plate having a plurality of cooling nozzles on said stool with said nozzles in fluid communication with said tubular members for passing a cooling medium through said tubular members, pouring a molten metal into a cavity defined by said upper and lower molds, effecting cooling of said molten metal in plural stages and plural stations to form a solid casting, removing said cooling plate from said stool and extracting said casting from said lower mold;

cooling medium feeding means disposed at each of said cooling stations; and cooling medium tube means communicating with said cooling nozzles, said cooling medium tube means having coupler means for connection to one of said cooling medium feeding means, said coupler means being disposed on said cooling plate.

2. A forced cooling casting apparatus according to claim 1 including a second track having means for conveying said removed cooling plate to said cooling plate setting station.

3. The forced cooling casting apparatus according to claim 1, including:

cooling medium jet means for jetting said cooling medium onto an exposed portion of said lower mold.

4. The forced cooling casting apparatus according to claim 1, including:

an extraction pin disposed on an exposed bottom portion of said lower mold;

extraction plate means for pushing said extraction pin and disposed at said cooling plate removing station;

means for raising said extraction plate means, thereby effecting mold release of said casting; and spring return means for said extraction pin.

5. The forced cooling casting apparatus of claim 1, including:

an abnormality detector having means for detecting abnormal setting of one of said cooling plate and said cooling nozzles, said abnormality detector being disposed between said station at which said cooling plate is disposed and said station for pouring said molten metal.

* * * * *

UNITED STATES PATENT AND TRADEMARK OFFICE

CERTIFICATE OF CORRECTION

PATENT NO. : 4,671,338

DATED : June 9, 1987

INVENTOR(S) : Yukio Otsuka, et al

It is certified that error appears in the above-identified patent and that said Letters Patent is hereby corrected as shown below:

On the Title Page, add --[30] Foreign Application Priority Data--

- Feb. 24, 1986 [JP] Japan ..... 061-38710 -

Signed and Sealed this

Twentieth Day of October, 1987

*Attest:*

DONALD J. QUIGG

*Attesting Officer*

*Commissioner of Patents and Trademarks*